US005704857A

United States Patent [19]

Davenport

[11] Patent Number: 5,704,857

[45] Date of Patent: Jan. 6, 1998

[54] HORSESHOE FOR PITCHING

[76] Inventor: Johnny W. Davenport, Box 394, Post, Tex. 79356

[21] Appl. No.: 788,861

[22] Filed: Jan. 23, 1997

[51] Int. Cl.[6] ..... A63B 65/00

[52] U.S. Cl. ..... 473/591; D21/50

[58] Field of Search ..... 473/591, 227; D21/4, 50; D30/147, 148, 150; 168/24

[56] References Cited

U.S. PATENT DOCUMENTS

D. 213,009 12/1968 Martz ..... 473/591 X
D. 288,575 3/1987 Donoho ..... D21/50
1,193,040 8/1916 Martin ..... 473/591
1,646,627 10/1927 Mossman et al. ..... 473/591
1,933,850 11/1933 Gordon ..... 473/591
2,059,378 11/1936 Madison ..... 473/591

*Primary Examiner*—Paul E. Shapiro
*Attorney, Agent, or Firm*—Morgan L. Crow, P.E.

[57] ABSTRACT

A horseshoe for pitching for recreation and in National Horseshoe Pitchers Association of America competition, wherein lugs or calks on top of a first horseshoe near the heel points can engage and shoulder against raised surfaces on the bottom of a second horseshoe positioned atop the first horseshoe. An alternate feature positions the transverse center of balance nearer the heel end of the horseshoe than prior art.

4 Claims, 1 Drawing Sheet

HORSESHOE FOR PITCHING

This invention is the subject of Disclosure Document 379,489 dated Mar. 27, 1996.

BACKGROUND OF THE INVENTION

1. The Field of the Invention

This invention relates to horseshoes used for pitching for recreation and competition. The object of the game is to pitch horseshoes toward a stake in order to cause the horseshoe to come to rest with the horseshoe completely surrounding the stake. This is called a ringer. The skillful player pitches the horseshoe so that the horseshoe comes to rest as a ringer, or is close to the stake. In a game, a contestant pitches two horseshoes, then another contestant pitches two horseshoes to make a total of four horseshoes pitched, which constitutes an inning. After the first horseshoe is pitched, subsequently pitched horseshoes may rebound off previously pitched horseshoes, possibly causing the pitched horseshoe to rebound away from a ringer position.

2. The Related Prior Art

In U.S. Pat. No. 1,646,627 issued to O. P. Mossman, et. al. in 1927 there is illustrated a pitching horseshoe having toe calks; and calks at the heel or open ends. Hooks are provided at the heel ends projecting toward each other to engage the stake and prevent the horseshoe from sliding away from a ringer position.

In U.S. Pat. No. D213,009 issued to Clyde Martz in 1968 there is illustrated a pitching horseshoe having a stepped configuration at the open ends or heel portion. This horseshoe includes a toe calk also known as a toe plate.

In U.S. Design Pat. No. 288,575 issued to Ray P. Donoho in 1984 there is illustrated a pitching horseshoe in which the characteristic feature resides in the calkers being on the opposite side of the horseshoe from the toe plate. The side of the horseshoe with the toe plate is unornamented.

SUMMARY OF THE INVENTION

In the game of horseshoe pitching in which participants pitch horseshoes sequentially over a predetermined distance or interval toward a ground stake, not shown, a horseshoe comprising a U shaped body defining a toe, spaced apart heels at the distal ends of the body, and legs joining to each of the heels, the body having a top surface for remaining exposed when pitched and a bottom surface for facing the ground when pitched, a calk located on the top surface of each leg and forming a shoulder at a first predetermined distance from the heel end and facing toward the heel, and an offset surface on the bottom surface of each leg forming a shoulder at a second predetermined distance from the heel and facing away from the heel, whereby a rebound encountered from a pitched horseshoe rebounding from striking the stake while overlaying a previously pitched horseshoe can effect an interfacing engagement between respective shoulders of each for minimizing the relative movement therebetween.

Also in the game of horseshoe pitching, a horseshoe comprising a U shaped body defining a toe, spaced apart heels at the distal ends of the body, and legs joining to each of the heels, the body having a top surface for remaining exposed when pitched and a bottom surface for facing the ground when pitched, the horseshoe having a maximum width of 7¼ inches across the legs, a maximum length of 7⅝ inches from heel to toe, a maximum weight of 2 pounds and 10 ounces, and having a transverse center of balance a distance of about 46% to 50% of the length of the shoe from each heel end.

DESCRIPTION OF THE PREFERRED EMBODIMENT

Figure 1:
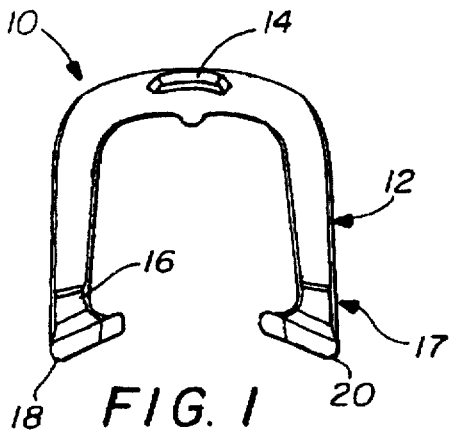
FIG. 1 (PRIOR ART)
FIG. 1 is a top view of a prior art pitching horseshoe.

FIG. 1 is an illustration of typical prior art, at 10. The body is illustrated at 12. The toe calk 14 and heel calks 16 and 17 are features carried over from horseshoes for horses. Calks are raised lugs projecting from the horseshoe, originally, to provide traction for the horse. The points 18 and 20 are is located at the extreme distal end of the heel end of the horseshoe. For purposes of this specification, the side of the horseshoe where the heel and toe calks are located is defined as the top, and the opposite side is defined as the bottom. These definitions are in keeping with the orientation of the horseshoe as it is held for pitching. For purposes of this specification, horseshoe is defined as a horseshoe for pitching. The hooks 22 and 24 are provided for the pitching horseshoe to hook on the stake, not shown, to hook and prevent a horseshoe from sliding away or being knocked away from the stake by another horseshoe pitched later. FIG. 1 is similar to horseshoe illustrated on page 11 of the *Official Rules of Horseshoe Pitching* published by The National horseshoe Pitchers Association of America, (NHPA). The *Official Rules of Horseshoe Pitching,* published by The National Horseshoe Pitchers Association of America hereinafter referred to as Rules.

Figure 2:
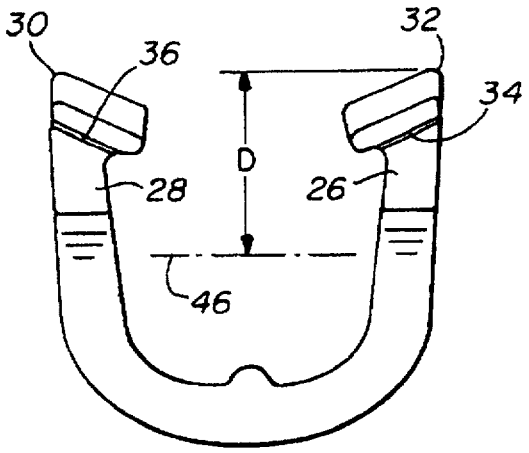
FIG. 2 is a top view of the preferred embodiment of the invention.
Figure 3:
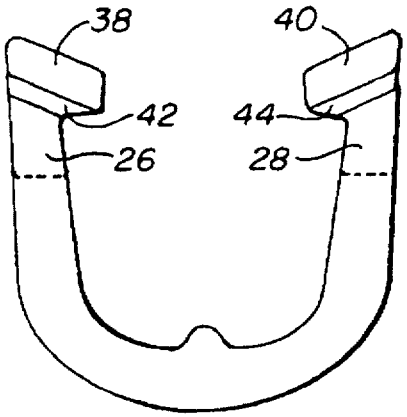
FIG. 3 is a bottom view of the preferred invention.
Figure 4:
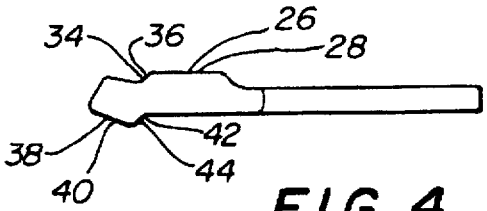
FIG. 4 is a side view showing the preferred invention.

Referring to FIGS. 2, 3 and 4, the preferred embodiment is illustrated. Heel calks 26 & 28 are positioned on the top of the horseshoe as shown, in FIG. 2, but are of greater length than prior art horseshoes for reasons to be described hereinafter. A toe calk is not shown, and is optional and is not required for use of the preferred embodiment. Points 30 and 32 define the heel end of the horseshoe. Heel calks 26 & 28 have shoulders 34 and 36 on the heel end of these calks. Any embodiment of this invention is intended to conform to the specifications in Rule 2 in the Rules—Playing Equipment—The horseshoe. These specifications in part specify the following maximum limits:

| Feature | Maximum |
|---|---|
| Weight | 2 pounds, 10 ounces |
| Width | 7¼ inches |
| Length | 7⅝ inches |
| Opening between points | 3½ inches - new |
| Opening between points | 3⅝ inches - used |

Additional conditions and specifications apply.

Referring still to FIG. 2, axis 46 is the transverse balance point at a distance D from the heel of the horseshoe. I have found that a design of the horseshoe that places the balance point nearer to the heels of the horseshoe is more desirable than the greater distance in prior art horseshoes. I have found that the best distance D for this balance point is substantially 3½ inches from the heel of the horseshoe. Balance measurements on existing horseshoes yields the following data:

| | | Distance to Transverse Center of Balance | | |
|---|---|---|---|---|
| Make | Model | Length | Inches | Percent |
| Glory | | 7⅝ | 3⅞ | 50.8 |
| Imperial | Original | 7⅝ | 3⅞ | 50.8 |
| M & M | Special | 7½ | 3 13/16 | 50.8 |
| Imperial | Plus | 7 9/16 | 3⅞ | 51.2 |
| Elmer Hohl | | 7½ | 3⅞ | 51.7 |
| Cal Flip | | 7 9/16 | 3 15/16 | 52.1 |
| Diamond | Tournament | 7 9/16 | 4 | 52.9 |
| Lattore | | 7 9/16 | 4 | 52.9 |
| Deadeye | Clydesdale | 7⅝ | 4 1/16 | 53.3 |
| Gordon | | 7½ | 4 | 53.3 |
| Deadeye | Regular | 7 7/16 | 4 | 53.8 |
| Deadeye | N-T | 7½ | 4 1/16 | 54.2 |
| Deadeye | E-Z Grip | 7 9/16 | 4⅛ | 54.5 |
| Diamond | Super Ringer | 7½ | 4⅛ | 55.0 |
| American | Professional | 7 9/16 | 4 3/16 | 55.4 |
| Diamond | Double Ringer | 7 7/16 | 4 3/16 | 56.3 |

The smallest percentage location I found is 50.8% of the distance from the points to the transverse center of balance Glory. My finding is that a balance point closer to the heel of the horseshoe is better than others provide. I have found that a balance much less than about 46% of the length is less beneficial. I have found that a range of about 46% of the length to 50% of the length from each heel end is the widest desirable range of distance for the transverse center of balance from the points. A more narrow range of desirable locations for this distance is about 47% of the length to about 49% of the length. The best distance from the heel to the transverse center of balance is about 48% of the length.

Some horseshoes I made are 7¼ inches long. A transverse center of balance at 3⅜ inches or 46.6% of the distance from each heel end is the minimum desirable distance. The best location for the transverse center of balance on a shoe 7¼ inches long is about 3½ inches or 48.3% of the length from each heel. The maximum desirable distance for a 7¼ inches long horseshoe is 3⅝ inches or 50.0% of the length from each heel.

The widest range of distance could be rounded to describe the location of the transverse center of balance at a distance 46% to 50% of the length from each heel end. The more narrow range could be rounded to 47%, to 49% of the length. The best distance is substantially 48%.

Referring to FIG. 3, hidden lines define the toe ends of calks 26 and 28. Referring to FIG. 4, in addition, the bottom surfaces 38 and 40 of the horseshoe are offset to form shoulders 42 and 44.

Figure 5:
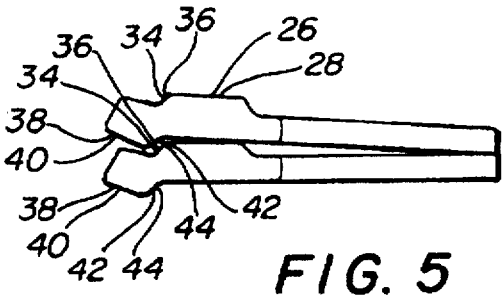
FIG. 5 is a side view showing two of the preferred invention.

Referring to FIG. 5, there are illustrated two horseshoes according to this invention stacked in alignment, one on the other. A game of horseshoes is played in innings. First one contestant pitches two horseshoes at a stake, then the other contestant pitches two horseshoes at the stake, so that four horseshoes are pitched at a stake, in each inning, according to the Rules. If a horseshoe comes to rest fully encircling the stake, it is a "ringer," and is the highest score and therefore is the desired result for all horseshoes pitched. If a ringer is achieved with the first horseshoe pitched by a contestant, it is desired that a ringer be achieved by the second horseshoe. The second horseshoe may bounce on top of the first horseshoe pitched. The dynamic energy of the pitched horseshoe can cause the second horseshoe to bounce on the second horseshoe and the stake, and bounce away from a ringer position. With my invention, the shoulders 34 and 36 may engage shoulders 42 and 44 to prevent the second horseshoe from bouncing away from a ringer position, as illustrated in FIG. 5.

Figure 6:
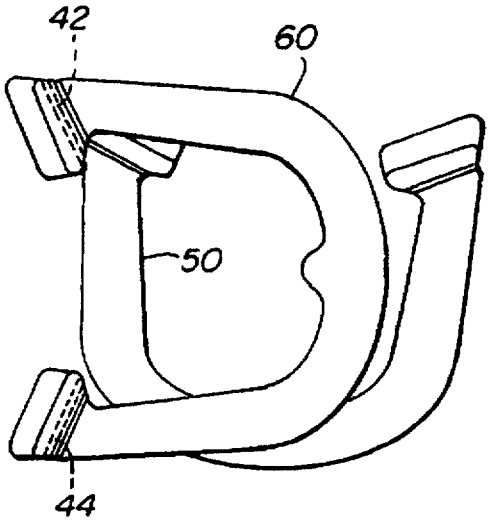
FIG. 6 is a side view of the preferred invention positioned atop another horseshoe.
Figure 7:
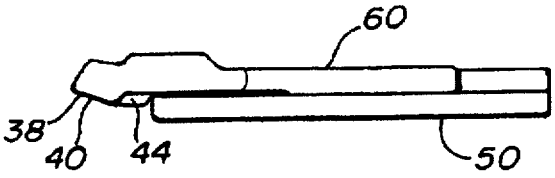
FIG. 7 is a top view for FIG. 6.

Referring to FIG. 6, a side view of the preferred invention 60 positioned atop another horseshoe 50. FIG. 7 is a top view of FIG. 6, illustrating a preferred embodiment 60 of this invention on any other horseshoe 50. The other horseshoe 50 may or not be a horseshoe according to this invention. The shoulders 42 and 44 extending away from the heels of the horseshoe are in position to engage the edge of a horseshoe 50 previously pitched, to deter the horseshoe 60 from bouncing away from a ringer position. Since there are four horseshoes pitched in an inning, there will be at least one horseshoe pitched for three of the subsequent horseshoes pitched, any one of which may be a ringer. Use of horseshoes according to my invention increases the likelihood of maintaining a ringer with horseshoes according to this invention, if a prior horseshoe is a ringer.

My invention may be described as a U shaped body defining a toe, spaced apart heels at the distal ends of the body, legs joining to each of the heels, the body having a top surface for remaining exposed when pitched and a bottom surface for facing the ground when pitched, and an offset surface at the bottom surface of each leg, forming a shoulder a predetermined distance from the heel and facing away from the heel, whereby a rebound encountered from a pitched horseshoe striking the stake while overlaying a previously pitched horseshoe can effect an interfacing engagement between said shoulder and said previously pitched horseshoe for minimizing the relative movement therebetween. This action would in some cases prevent a horseshoe that is a ringer, surrounding the stake, from bouncing away from the stake to a position that is not a ringer. A person pitching horseshoes according to my invention would be likely to score better than a person using prior art horseshoes.

The use of a toe calk (not shown) is not material to my invention, and may or may not be used. Therefore no toe calk such as illustrated in Donoho is illustrated, described, or claimed in my invention.

Although elements of the invention have been illustrated in the accompanying drawings and described in the foregoing Description it will be understood that the invention is not limited to the embodiments disclosed, but is capable of rearrangements, modifications, substitutions and reversals of parts and elements without departing from the spirit of the invention.

I claim:

1. In the game of horseshoe pitching in which participants pitch horseshoes sequentially a predetermined distance toward a ground stake, a horseshoe comprising:

a U shaped body defining a toe, spaced apart heels at the distal ends of said body, and legs joining to each of said heels, said body having a top surface for remaining exposed when pitched and a bottom surface for facing the ground when pitched, a calk located on the top surface of each leg and forming a shoulder at a first predetermined distance from the heel end and facing toward the heels, and an offset surface on the bottom surface of each leg forming a shoulder at a second predetermined distance from the heels and facing away from the heels, whereby a rebound encountered from a pitched horseshoe rebounding from striking the stake while overlaying a previously pitched horseshoe can effect an interfacing engagement between respective shoulders of each for minimizing the relative movement therebetween.

2. In the game of horseshoe pitching in which participants pitch horseshoes sequentially over a predetermined interval toward a ground stake, a horseshoe comprising:

a U shaped body defining a toe, spaced apart heels at the distal ends of said body, and legs joining to each of said heels, said body having a top surface for remaining exposed when pitched and a bosom surface for facing the ground when pitched, said horseshoe having a maximum width of 7¼ inches across the legs, a maximum length of 7⅝ inches from heel to toe, a maximum weight of 2 pounds and 10 ounces, and having a transverse center of balance at a distance 46% to 50% of the length from each heel end.

3. A horseshoe according to claim 2, wherein said distance is 47% to 49% of the length.

4. A horseshoe according to claim 2, wherein said distance is substantially 48%.

* * * * *